US005631439A

United States Patent [19]

Sallee et al.

[11] Patent Number: 5,631,439

[45] Date of Patent: May 20, 1997

[54] MULTIPLE SQUIB ASSEMBLY

[75] Inventors: Bradley T. Sallee, Austin; Beryl W. Cotton, III, Lexington, both of Tex.

[73] Assignee: Tracor Aerospace, Inc., Austin, Tex.

[21] Appl. No.: 478,224

[22] Filed: Jun. 7, 1995

[51] Int. Cl.[6] ..... F42C 11/00

[52] U.S. Cl. ..... 102/217; 102/202.9; 102/202.14; 102/472; 102/505; 102/530

[58] Field of Search ..... 86/1.1, 10; 102/200, 102/202.5, 202.9, 202.12, 202.14, 206, 211, 214, 217, 340, 342, 345, 346, 351, 352, 357, 360, 472, 505, 530, 531; 280/741; 422/166

[56] References Cited

U.S. PATENT DOCUMENTS

| | | | |
|---|---|---|---|
| 2,462,135 | 2/1949 | Skinner | 102/202 |
| 2,988,876 | 6/1961 | Walden | 102/202 |
| 2,990,683 | 7/1961 | Walden | 102/202 |
| 3,745,925 | 7/1973 | Hesler, Jr. | 102/206 |
| 4,335,656 | 6/1982 | Beatty et al. | 102/340 |
| 4,586,439 | 5/1986 | Wrana | 102/357 |
| 4,619,202 | 10/1986 | Romer et al. | 102/472 |
| 5,131,679 | 7/1992 | Novak et al. | 102/530 |
| 5,220,480 | 6/1993 | Kershaw, Jr. et al. | 361/117 |
| 5,230,287 | 7/1993 | Arrell, Jr. et al. | 102/202.5 |
| 5,269,560 | 12/1993 | O'Loughlin et al. | 102/531 |
| 5,433,147 | 7/1995 | Brede et al. | 102/202.5 |

OTHER PUBLICATIONS

Circuit Board Subassembly blue line prepared by the U.S. Air Force on Aug. 9, 1990, drawing No. 8746888, sheet 1 of 1.

*Primary Examiner*—Harold J. Tudor
*Attorney, Agent, or Firm*—Arnold, White & Durkee

[57] ABSTRACT

A multiple squib assembly is provided for use in a chaff deployment system. A method of manufacture is also provided. The assembly of this invention represents an improvement over prior art squib assemblies, such as the BBU48. In preferred embodiments, the assembly comprises a brass base plate, a pair of squibs, a center contact connected to the squibs, and a zener diode connected between one of the squibs and the baseplate. All of those components are retained within a molded rubber or plastic body, which is shaped to hold the components in the desired relative position and to form sealing elements around each of the squibs. A reliable, integral assembly is thus provided using a minimal number of parts and electrical connections. In alternative embodiments, a larger number of squibs may be incorporated into the assembly, and alternative discrimination elements may be employed.

15 Claims, 2 Drawing Sheets

MULTIPLE SQUIB ASSEMBLY

BACKGROUND OF THE INVENTION

1. Field of the Invention

This invention concerns chaff deployment systems, which are primarily employed in military aircraft. In particular, the present invention is an improved squib assembly for use in chaff deployment systems and similar applications.

2. Description of the Prior Art

Chaff deployment systems are used in military aircraft to deploy radar reflective chaff at the command of the operator of the aircraft, typically as a defensive measure to act as a decoy to enemy radar systems.

A typical chaff deployment system that is presently used includes a magazine having 30 chaff cartridges, such as RR180 chaff cartridges. Each cartridge has two chaff chambers extending lengthwise in the cartridge for containing the chaff material, which may be metalicized glass material or other types of chaff known in the art. The front end of each loaded cartridge is covered by an end cap. The back end of each cartridge is configured to receive a dual squib assembly. That assembly includes two squibs, each of which communicates with one of the chaff chambers and can be fired electrically to generate high pressure gases sufficient to force the end cap off and the chaff out of the corresponding chaff chamber.

The squib assembly includes structures for properly positioning the squibs, for sealing the joint between the squibs and the chaff chamber, for providing electrical energy to ignite the squibs, and for interfacing the squib assembly to the aircraft. The chaff cartridge magazine is typically connected to a chaff dispenser on the aircraft. The dispenser includes electrical contacts that correspond with the contacts on the array of squib assemblies. The base of each squib assembly is typically grounded, and each squib assembly has a center contact that conducts an electrical firing signal to each squib. One of the squibs in a squib assembly may be directly connected to the center contact, while the other squib may be connected through a diode, a resistor, or other means for allowing selective firing of the two squibs connected to the single contact.

The BBU48 is a prior art squib assembly for use with the above-described type of chaff dispensing system. The BBU48 assembly is shown in FIG. 1. It comprises two 1083-type squib components 12, and it includes many additional components, including a printed circuit board 14, a machined aluminum alloy base 16, a positive contact 18, a zener diode 20, a cover plate 22, and a pair of sealing gaskets 24, one around each squib component. The BBU48 is functionally adequate, but difficult and expensive to make, due to the number of parts and the amount of work required to fabricate and assemble the parts. Furthermore, the ground connection between the printed circuit board 22 and the machined base of the BBU48 relies on a mechanical compression connection, which is susceptible to open circuit faults caused by thermal cycling, mechanical shock and vibration.

It is desirable to provide a functionally equivalent and interchangeable dual squib assembly to replace the BBU48 that is easier and less expensive to assemble. It is further desirable to provide a dual squib assembly that has fewer parts and that has a correspondingly higher degree of ruggedness and reliability.

SUMMARY OF THE INVENTION

The present invention provides an improved, reduced component multiple squib assembly that can be substituted for the prior art BBU48 squib assembly. The improved assembly has only four components in addition to the squibs and potting compound. The machined base of the BBU48 is replaced with a stamped brass baseplate. Alternatively, the base plate could be fabricated from other materials with appropriate platings. The printed circuit board is eliminated. The cover plate is eliminated. The sealing gaskets are eliminated. In the present invention, all of the components are imbedded in or attached to a molded plastic structure, thus forming a rugged unitary assembly.

Preferred embodiments of the present invention may be manufactured as follows. Two squibs are positioned in a fixture. The positive lead of each squib is coupled to a center contact, which may be brass. The positive lead of one of the squibs may be attached to a squib discrimination element, typically a diode, which is in turn attached to the center contact. The negative or ground lead of each squib is connected to a baseplate, which may be a brass stamping. The baseplate has a hole at its center to provide access to the center contact. The fixture holds the squibs, the center contact, the diode and the baseplate in position while a potting material, which may be urethane or high temperature thermoplastic, is molded around the components to connect and partially encapsulate them. The fixture is shaped to mold seals around the squibs to interface with a chaff cartridge, and to mold the overall assembly to fit a corresponding recess in a chaff cartridge and to interface with a typical chaff dispenser.

The present invention thus provides an improved squib assembly that provides the functionality of the prior art BBU48 dual squib assembly at substantially reduced cost. The present invention also provides improved ruggedness due to complete encapsulation of connections and a reduced number of components and connections in the assembly.

These and other advantages of the present invention will be further appreciated from the drawings and from the detailed description provided below.

BRIEF DESCRIPTION OF THE DRAWINGS

So that the manner in which the herein described advantages and features of the present invention, as well as others which will become apparent, are attained and can be understood in detail, more particular description of the invention summarized above may be had by reference to the embodiment thereof which is illustrated in the appended drawings, which drawings form a part of this specification.

It is to be noted, however, that the appended drawings illustrate only exemplary embodiments of the invention and are therefore not to be considered limiting of its scope, for the invention may admit to other equally effective embodiments.

DETAILED DESCRIPTION OF THE PREFERRED EMBODIMENTS

Figure 1:
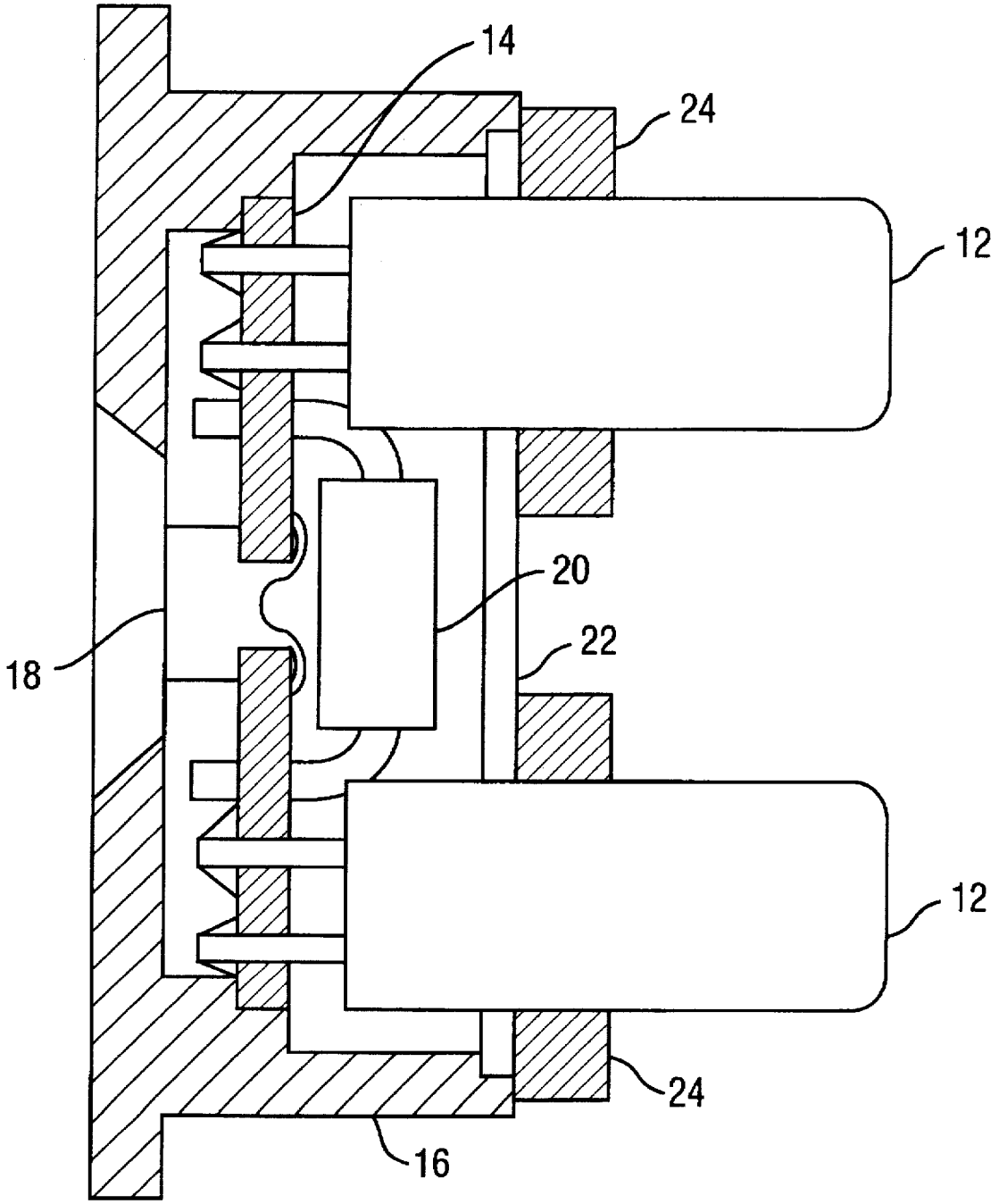
FIG. 1 (Prior Art)
FIG. 1 is a cross-sectional view of a BBU48 dual squib assembly as is known in the prior art.
Figure 2:
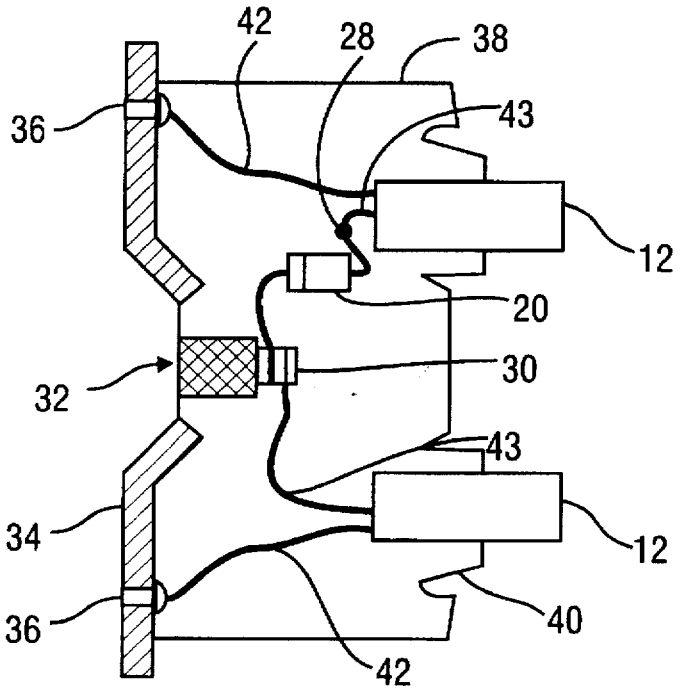
FIG. 2 is a cross-sectional view of a dual squib assembly according to a preferred embodiment of the present invention.

FIG. 2 shows a cross-sectional view of a preferred embodiment of the present invention, and it lends itself to comparison with the prior art device shown in FIG. 1. Referring to FIG. 2, squibs 12, which may be 1083-type squibs, are mounted in potting compound 38. Potting compound may comprise urethane or a rigid but resilient thermoplastic or rubberized plastic, or other materials known to those skilled in the art. The potting compound may be selected to have a hardness of about 90 Shore D at room temperature. It is important that the potting compound be tolerant of high temperatures encountered in the intended environment of use. The potting compound 38 may be molded to form sealing elements or structures 40 around each squib, to seal the joint between squib 12 and the chaff cartridge (not shown).

Figure 3:
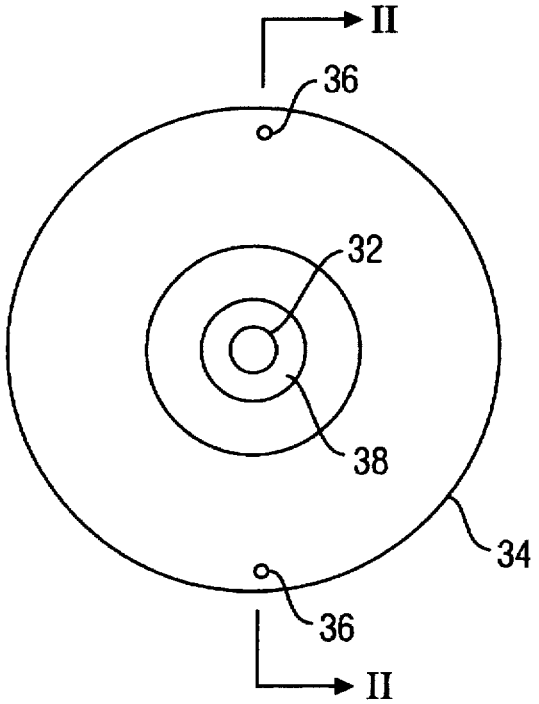
FIG. 3 shows the squib assembly viewed from the base plate end of the assembly.

The ground or negative lead 42 from each squib is connected to baseplate 34, which may be a stamped bass component. Referring to FIG. 3, viewing the squib assembly from the left-hand side in FIG. 2, the base plate 34 is a circular structure having a hole or orifice in the center. Two small holes 36 may be formed in base plate 34 to receive ground wires 42 from squibs 12. Ground wires 42 may be soldered or otherwise securely and conductively fastened to baseplate 34. When the squib assembly is mounted in a chaff cartridge and connected to a chaff dispenser on an aircraft, the baseplate is grounded with respect to the aircraft's electrical systems.

The positive lead 43 of each squib 12 is connected to center contact 32, which is positioned in the hole in baseplate 34 and held in place by potting compound 38. Center contact 32 has connection post 30 to which the positive leads 43 may be soldered or otherwise securely and conductively attached. Center contact 32 may be made from brass using a screw machine. Center contact 32 does not touch baseplate 34, and is insulated from baseplate 34 by potting compound 38.

In presently preferred embodiments, the base plate and center contact are made of brass, but they may alternatively be made of other materials, such as other metals with appropriate plating, such as nickel-plated stainless steel.

In order to provide the ability to selectively fire one squib at a time, a zener diode 20 may be placed in series with the positive lead of one of the squibs 12. One of the leads of the zener diode 20 may be attached to positive lead 43 of squib 12 by a solder joint 28 or other means known in the art. The other lead of zener diode 20 is then attached to post 30 of center contact 32. When the squib assembly is installed on an aircraft, the chaff deployment system on the aircraft makes electrical contact with center contact 32, and the chaff charges are deployed by voltage pulses applied to center contact 32. A first voltage pulse that is below the breakdown voltage of zener diode 20 will fire the squib that is not connected in series with zener diode 20, while zener diode 20 prevents current from flowing through the second squib. A second voltage pulse higher than the zener breakdown voltage is then applied to center contact 32 to fire the second squib.

The present invention is not limited to assemblies having only two squibs. The structure disclosed may be modified by one skilled in the art to include only one squib, or to include three or more squibs. Squib discrimination elements, which may be diodes, resistors, or other electrical elements or combinations of elements, may be employed to discriminate signals for igniting each of several squibs in an assembly at selected times using remote control techniques. Furthermore, other types of payloads may be manufactured into an assembly according to the present invention. For example, flare payloads may be well-suited for use in this type of assembly.

The improved dual squib assembly shown in FIG. 2 may be manufactured using a suitable fixture for holding the components and molding the potting compound in the desired shape. In particular, in preferred embodiments, the zener diode 20 is attached to positive lead 43 of one squib. The other zener diode lead and the other positive squib lead 43 are attached to contact post 30 of center contact 32. Center contact 32 is held in the desired position by the fixture. Ground leads 42 of squibs 12 are passed through holes 36 in baseplate 34 and soldered in place. Baseplate 32 is also held in place in the fixture. The fixture is designed to mold the potting compound into the desired shape, including seals 40 around each squib 12. Potting compound 38 is injected into the fixture to surround the various components and cured to provide a substantially rigid structure for the squib assembly. A person skilled in the art will recognize that the fixture is preferably provided with sealing elements to prevent potting compound from contaminating the outer surface of center contact 32 and the outer surface of baseplate 34. In the completed squib assembly these surfaces are to be substantially free of any insulating materials so the proper electrical connection may be established with the dispenser. Suitable molding techniques for manufacturing squib assemblies according to this invention are known in the art. After the molding step is completed, the dual squib assembly can then be removed from the fixture as a unitary assembly.

The present invention shown in FIG. 2 provides a substantial improvement over the BBU48 shown in FIG. 1 in terms of ease and cost of manufacturing. The machined metal body 16 of the BBU48 is replaced by an inexpensive stamped brass baseplate 34. The printed circuit board 14, of the BBU48 is eliminated, as are the extra connections associated with the printed circuit board. Cover plate 22 is eliminated, as are separate sealing gaskets 24. The number of soldered connections in the assembly is reduced from eight to five, and the number of pieces is reduced from nine to five (not including potting compound)). Importantly, the two pieces of the BBU48 that were most difficult and costly to manufacture, machined body 16 and printed circuit board 14, have been eliminated in the new assembly. Finally, the mechanical contact ground connection between printed circuit board 14 and body 16 of the BBU48 is replaced by more reliable soldered connections. Other electrical connection techniques may also be employed between the components of this invention to form a robust squib assembly.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A multiple squib assembly for use in a chaff deployment system, the squib assembly comprising:

a brass base plate having an orifice formed therein;

a brass center contact positioned in the orifice in the base plate, said brass center contact and said orifice defining an insulative space therebetween;

a first squib and a second squib positioned in complementary relationship, each squib having a first end, a second end, a ground lead and a positive lead, the ground lead of each squib being connected to the base plate, and the positive lead of the first squib being connected to the center contact, and wherein each of staid second ends of said first and second squibs are insertable for insertion into a chaff chamber of said chaff deployment system;

a zener diode directly coupled in series between the positive lead of the second squib and the center contact; and potting material engaging and retaining the first ends of said first and second squibs, the base plate, the center contact, the ground leads, the positive leads, and the zener diode, said potting material being shaped to form a first seal around said first squib and a second seal around said second squib, each of said first and second seals sealably insertable into a chaff chamber of said chaff deployment system, and wherein said potting material is disposed in said insulative space so as to insulate said brass center contact from said base plate.

2. A multiple squib assembly for use in a chaff deployment system having a chaff cartridge with first and second chaff chambers, the multiple squib assembly consisting essentially of:

a base plate having an orifice formed therein;

a center contact positioned in the orifice in the base plate said center contact and said orifice defining an insulative space therebetween;

a first squib and a second squib positioned in complementary relationship, each squib having a first end, a second end, a ground lead and a positive lead, the ground lead of each squib being attached to the base plate, and the positive lead of the first squib being attached to the center contact, and wherein each of said second ends of said first and second squibs are insertable into said respective first and second chaff chambers;

a discriminating element operatively coupled to the second squib and to the center contact; and potting material engaging the first ends of the first and second squibs, the base plate, the center contact the ground leads, the positive leads, and the discriminating element, said potting material being shaped to form a first seal around said first squib and a second seal around said second squib, each of said first and second seals sealably insertable insertion into said respective first and second chaff chambers of said chaff cartridge, and wherein said potting material is disposed in said insulative space so as to insulate said center contact from said base plate.

3. The assembly of claim 2, wherein the potting material is urethane.

4. The assembly of claim 2, wherein the potting material is thermoplastic.

5. The assembly of claim 2, wherein the base plate and the center contact are made of brass.

6. The assembly of claim 2, wherein the discriminating element is a zener diode.

7. A method of manufacturing a dual squib assembly, comprising:

providing a first squib and a second squib, each squib having a first end, a second end, a ground lead and a positive lead, and wherein each of said second ends of said first and second squibs are insertable into a payload chamber of a payload deployment system;

connecting an anode of a zener diode to the positive lead of the second squib and connecting the cathode of the zener diode to a center contact;

connecting the positive lead of the first squib to the center contact;

connecting the negative leads of both squibs to a base plate having an orifice formed therein;

positioning the squibs, the zener diode, the base plate, the ground leads, the positive leads and the center contact in a fixture so that said center contact is positioned in the orifice in such a way to define an insulative space between said orifice and said center contact, the fixture being adapted to receive potting compound and to mold the potting compound to engage the first ends of said first and second squibs, the zener diode, the base plate, the ground leads, and the positive leads, and the center contact, and so that it forms a first squib sealing structure around said first squib and a second squib sealing structure around said second squib, each of said first and second squib sealing structures sealably insertable into a payload chamber of said payload deployment system;

injecting potting compound into the fixture such that it engages the first ends of said first and second squibs, the zener diode, the base plate, the ground leads, the positive leads, and the center contact, and wherein the potting compound fills said insulative space so as to insulate said center contact from said base plate and forms said first and second sealing structures; and removing the completed assembly from the fixture.

8. The method of claim 7, further comprising curing the potting compound after injecting it into the fixture.

9. The method of claim 7, wherein the connecting steps comprise soldering.

10. The method of claim 7, wherein the injecting step comprises injecting a urethane potting compound.

11. The method of claim 7, wherein the injecting step comprises injecting a thermoplastic potting compound.

12. A squib assembly, comprising:

a base plate having an orifice formed therein;

a center contact positioned in the orifice, said center contact and said orifice defining an insulative space therebetween;

one or more squibs, each having a first end, a second end, a first contact and a second contact, said first contact and said second contact connected adjacent said first end, each said first contact connected to the baseplate and each said second contact connected to the center contact, and wherein each of said second ends of said one or more squibs are insertable into a payload chamber; and insulating material engaging and retaining the baseplate, the center contact, the first contact, the second contact, and the first ends of each of said one or more squibs, said insulating material terminating at a point between said first and second ends of said squibs so that said second ends of said squibs extend free of said insulating material from said point, and wherein said insulating material is disposed in said insulative space.

13. The assembly of claim 12, further comprising at least two squibs and a discriminating element connected to one of the squibs.

14. The assembly of claim 13, wherein the discriminating element is a zener diode.

15. The assembly of claim 12, wherein the insulating material is formed into squib sealing elements encircling each squib at a point between said first and second ends of each squib, each of said first and second squib elements sealably insertable into said payload chamber.

* * * * *

UNITED STATES PATENT AND TRADEMARK OFFICE

CERTIFICATE OF CORRECTION

PATENT NO. : 5,631,439

DATED : May 20, 1997

INVENTOR(S) : Bradley T. Sallee and Beryl W. Cotton, III

It is certified that error appears in the above-identified patent and that said Letters Patent is hereby corrected as shown below:

In claim 1, column 5, line 5, delete "staid" and insert --said-- therefor.
In claim 2, column 5, line 26, after 'plate', insert --,-- therefor.
In claim 2, column 5, line 41, after 'contact', insert --,-- therefor.

Signed and Sealed this

Nineteenth Day of August, 1997

*Attest:*

Bruce Lehman

BRUCE LEHMAN

*Attesting Officer*

*Commissioner of Patents and Trademarks*